US012808284B2

(12) United States Patent
Kash et al.

(10) Patent No.: US 12,808,284 B2
(45) Date of Patent: Nov. 24, 2026

(54) TANDEM SUBS FOR PERFORATING GUN SYSTEMS

(71) Applicant: G&H Diversified Manufacturing LP, Houston, TX (US)

(72) Inventors: James Edward Kash, Houston, TX (US); Ryan Ward, Tomball, TX (US); Benjamin Vascal Knight, Katy, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 1 day.

(21) Appl. No.: 18/940,488

(22) Filed: Nov. 7, 2024

(65) Prior Publication Data

US 2025/0146388 A1 May 8, 2025

Related U.S. Application Data

(60) Provisional application No. 63/596,645, filed on Nov. 7, 2023.

(51) Int. Cl.
*E21B 43/116* (2006.01)

(52) U.S. Cl.
CPC ..... *E21B 43/116* (2013.01)

(58) Field of Classification Search
CPC ..... E21B 43/116; E21B 43/1185
See application file for complete search history.

(56) References Cited

U.S. PATENT DOCUMENTS

2022/0163298 A1* 5/2022 Kash ..... F42D 1/04

* cited by examiner

*Primary Examiner* — Blake Michener
*Assistant Examiner* — Nicholas D Wlodarski
(74) *Attorney, Agent, or Firm* — Conley Rose, P.C.

(57) ABSTRACT

A method for forming a tandem sub for a perforating gun system includes forming a tubular housing including a longitudinal first end, a longitudinal second end opposite the first end, a central passage defined by an inner surface that forms a seal bore defining a minimum inner diameter of the central passage and an annular receptacle, wherein the housing is connectable to an outer housing of a perforating gun, and installing a pass-thru assembly including an electrically conductive signal bar and a surrounding electrical insulator in the central passage of the housing whereby a radial gap is formed between an outer surface of the insulator of the pass-thru assembly at a longitudinal end of the pass-thru assembly and a portion of the inner surface of the housing defining the receptacle.

43 Claims, 6 Drawing Sheets

TANDEM SUBS FOR PERFORATING GUN SYSTEMS

CROSS-REFERENCE TO RELATED APPLICATIONS

The present application claims benefit of U.S. provisional patent application No. 63/596,645 filed Nov. 7, 2024, and entitled "Tandem Subs for Perforating Gun Systems", which is incorporated herein by reference in its entirety.

STATEMENT REGARDING FEDERALLY SPONSORED RESEARCH OR DEVELOPMENT

Not applicable.

BACKGROUND

During completion operations for a subterranean wellbore, it is conventional practice to perforate the wellbore and any casing pipes disposed therein with a perforating gun of a tool string at each production zone to provide a path(s) for formation fluids (e.g., hydrocarbons) to flow from a production zone of a subterranean formation into the wellbore. To ensure that each production zone is isolated within the wellbore, plugs, packers, and/or other sealing devices are installed within the wellbore between each production zone prior to perforation activities. In some applications, one or more of the perforating guns and/or other components of the tool string may comprise a detonator for firing a charge or explosive. For instance, a perforating gun of the tool string may comprise a detonator configured to initiate an explosion of one or more shaped charged of the perforating gun in response to receiving an electrical signal. An electrical signal may be transmitted from the surface to the detonator to activate the detonator and thereby initiate the explosion of the one or more shaped charges.

SUMMARY OF THE DISCLOSURE

An embodiment of a tandem sub for a perforating gun system comprises a tubular housing comprising a longitudinal first end, a longitudinal second end opposite the first end, a central passage defined by an inner surface that forms a seal bore defining a minimum inner diameter of the central passage and an annular receptacle, wherein the housing is connectable to an outer housing of a perforating gun, and an electrical pass-thru assembly configured to electrically connect to the perforating gun and comprising a longitudinal first end, a longitudinal second end opposite the first end, an electrically conductive signal bar, and an electrical insulator surrounding a periphery of the signal bar, wherein the signal bar has a longitudinal first end defining a first electrical contact of the tandem sub and configured to establish an electrical connection with a first electrical component separate from and external the tandem sub, and a longitudinal second end opposite the first end and defining a second electrical contact of the tandem sub that is longitudinally opposite and electrically connected to the first electrical contact and configured to establish an electrical connection with a second electrical component separate from and external the tandem sub, wherein the signal bar is rigid along the entire longitudinal length thereof extending from the first end to the second end, wherein the insulator has an outer surface sealingly contacting the seal bore of the housing when the pass-thru assembly is installed in the housing, wherein one of the first end and the second end of the pass-thru assembly longitudinally overlaps the receptacle of the housing when the pass-thru assembly is installed in the housing whereby a radial gap is formed between the outer surface of the insulator and a portion of the inner surface of the housing defining the receptacle. In some embodiments, the radial gap is equal to or greater than 0.040 inches. In some embodiments, the radial gap is equal to or greater than 0.050 inches. In certain embodiments, the radial gap is equal to or greater than 0.060 inches. In some embodiments, a ratio of the radial gap to an outer diameter of the pass-thru assembly is between 5% and 25%. In some embodiments, a ratio of the radial gap to an outer diameter of the pass-thru assembly is between 6% and 18%. In certain embodiments, a ratio of the radial gap to an outer diameter of the pass-thru assembly is between 7.5% and 12%. In certain embodiments, the receptacle of the housing is located directly adjacent to the seal bore. In some embodiments, the radius of the receptacle is at least 20% greater than the radius of the seal bore. In some embodiments, the radius of the receptacle is at least 40% greater than the radius of the seal bore. In certain embodiments, the radius of the receptacle is at least 50% greater than the radius of the seal bore. In certain embodiments, the radius of the receptacle is at least 100% greater than the radius of the seal bore. In some embodiments, the first end of the pass-thru assembly corresponds to an uphole end of the pass-thru assembly when the pass-thru assembly is installed in the housing. In some embodiments, the pass-thru assembly comprises one or more annular seal assemblies positioned along the outer surface of the insulator for sealing against the seal bore of the housing when the pass-thru assembly is installed in the outer housing. In certain embodiments, the signal bar is positioned in the central passage of the housing. In certain embodiments, the central passage of the housing comprises a longitudinal first end, a longitudinal second end opposite the first end, and wherein the pass-thru assembly creates a pressure seal between the first end and the second end of the central passage. In some embodiments, the insulator of the pass-thru assembly comprises a molded insulator sealably adhered to an outer surface of the signal bar. In some embodiments, the insulator extends continuously across the entire longitudinal length of the signal bar.

An embodiment of a method for forming a tandem sub for a perforating gun system comprises (a) forming a tubular housing comprising a longitudinal first end, a longitudinal second end opposite the first end, a central passage defined by an inner surface that forms a seal bore defining a minimum inner diameter of the central passage and an annular receptacle, wherein the housing is connectable to an outer housing of a perforating gun, and (b) installing a pass-thru assembly comprising an electrically conductive signal bar and a surrounding electrical insulator in the central passage of the housing whereby a radial gap is formed between an outer surface of the insulator of the pass-thru assembly at a longitudinal end of the pass-thru assembly and the portion of the inner surface of the housing defining the receptacle. In certain embodiments, the magnitude of the radial gap is selected based on one or more parameters of an electrical circuit formable using the signal bar of the pass-thru assembly. In certain embodiments, the method comprises (c) positioning one or more annular seal assemblies along the outer surface of the insulator of the pass-thru assembly whereby the one or more seal assemblies seal against the portion of the inner surface of the housing defining the seal bore when the pass-thru assembly is installed in the central passage of the housing. In some embodiments, (b) comprises longitudinally sliding the pass-thru assembly into and through the central passage of the housing whereby the end of the pass-thru assembly longitudinally overlaps the receptacle of the housing. In some embodiments, the radial gap is equal to or greater than 0.040 inches. In certain embodiments, the radial gap is equal to or greater than 0.050 inches. In certain embodiments, the radial gap is equal to or greater than 0.060 inches. In some embodiments, a ratio of the radial gap to an outer diameter of the pass-thru assembly is between 5% and 25%. In some embodiments, a ratio of the radial gap to an outer diameter of the pass-thru assembly is between 6% and 18%. In certain embodiments, a ratio of the radial gap to an outer diameter of the pass-thru assembly is between 7.5% and 12%. In some embodiments, the radius of the receptacle is at least 20% greater than the radius of the seal bore. In some embodiments, the radius of the receptacle is at least 40% greater than the radius of the seal bore. In certain embodiments, the radius of the receptacle is at least 50% greater than the radius of the seal bore. In certain embodiments, the radius of the receptacle is at least 100% greater than the radius of the seal bore.

An embodiment of a method for operating a perforating gun system comprises (a) connecting a tandem sub of the perforating gun system to a perforating gun of the perforating gun system, the tandem sub comprising a tubular housing having a central passage and a pass-thru assembly comprising an electrically conductive signal bar and a surrounding electrical insulator, the pass-thru assembly installed in the central passage of the housing whereby a radial gap is formed between an outer surface of the insulator of the pass-thru assembly at a longitudinal end of the pass-thru assembly and the portion of the inner surface of the housing defining the receptacle, (b) conveying a tool string comprising the tandem sub and the perforating gun connected therewith into a wellbore, (c) establishing an electrical signal path extending through the signal bar of the pass-thru assembly of the tandem sub, and (d) establishing an electrical ground path extending through the housing of the tandem sub and spaced from the signal path by the radial gap. In some embodiments, the radial gap is equal to or greater than 0.040 inches. In some embodiments, the radial gap is equal to or greater than 0.050 inches. In some embodiments, a ratio of the radial gap to an outer diameter of the pass-thru assembly is between 5% and 25%. In some embodiments, a ratio of the radial gap to an outer diameter of the pass-thru assembly is between 6% and 18%. In certain embodiments, a ratio of the radial gap to an outer diameter of the pass-thru assembly is between 7.5% and 12%. In certain embodiments, the radial gap is equal to or greater than 0.060 inches. In certain embodiments, the radius of the receptacle is at least 20% greater than the radius of the seal bore. In some embodiments, the radius of the receptacle is at least 40% greater than the radius of the seal bore. In some embodiments, the radius of the receptacle is at least 50% greater than the radius of the seal bore. In certain embodiments, the radius of the receptacle is at least 100% greater than the radius of the seal bore.

BRIEF DESCRIPTION OF THE DRAWINGS

For a detailed description of exemplary embodiments of the disclosure, reference will now be made to the accompanying drawings in which.

DETAILED DESCRIPTION

Figure 1:
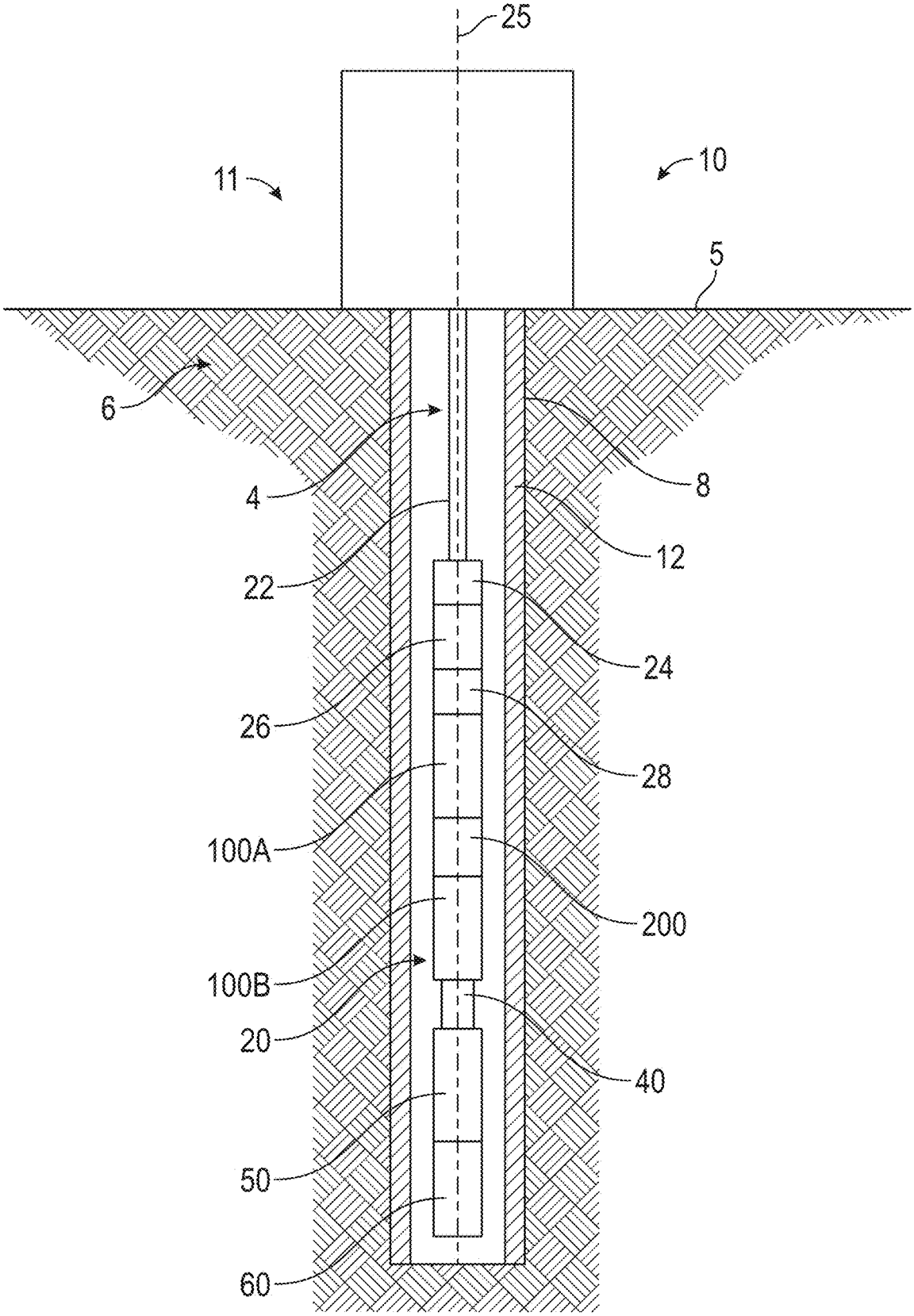
FIG. 1 is a schematic, view of a system for completing a subterranean well including a tool string in accordance with the principles disclosed herein.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a perforating gun or completion system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. Completion system 10 includes a surface assembly 11 positioned at a wellsite 13 of system 10, and a tool string 20 deployable into wellbore 4 from a surface 5 using surface assembly 11.

Surface assembly 11 may comprise any suitable surface equipment for drilling, completing, and/or operating well 20 and may include, in some embodiments, derricks, structures, pumps, electrical/mechanical well control components, etc. Tool string 20 of completion system 10 may be suspended within wellbore 4 from a wireline 22 that is extendable from surface assembly 11. Wireline 22 comprises an armored cable and includes at least one electrical conductor for transmitting power and electrical signals between tool string 20 and a control system or firing panel of surface assembly 11 positioned at the surface 5.

In some embodiments, system 10 may further include suitable surface equipment for drilling, completing, and/or operating completion system 10 and may include, for example, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 has a central or longitudinal axis 25 and generally includes a cable head 24, a casing collar locator (CCL) 26, a direct connect sub 28, a pair of perforating guns or tools 100A, 100B, a reusable tandem sub 200, a plug-shoot firing head (PSFH) 40, a setting tool 50, and a downhole or frac plug 60. In other embodiments, the configuration of tool string 20 may vary from that shown in FIG. 1. For example, in other embodiments, tool string 20 may include a fishing neck, weight bars, a release tool, and/or a safety sub selectably restricting electrical communication to one or more components of tool string 20. Cable head 24 is the uppermost component of tool string 20 and includes an electrical connector for providing electrical signal and power communication between the wireline 22 and the other components (CCL 26, perforating guns 100A, 100B, tandem sub 200, PSFH 40, setting tool 50, etc.) of tool string 20. CCL 26 is coupled to a lower end of the cable head 24 and is generally configured to transmit an electrical signal to the surface via wireline 22 when CCL 26 passes through a casing collar of casing string 12, where the transmitted signal may be recorded at surface assembly 11 as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including perforating guns 100A, 100B and associated tools, such as the setting tool 50 and downhole plug 60.

A first or upper perforating gun 100A of tool string 20 is coupled to direct connect sub 28 while a second or lower perforating gun 100B of string 20 is coupled to tandem sub 200 which is positioned between the pair of perforating guns 100A, 100B. Perforating guns 100A, 100B are generally configured to perforate casing string 12 and provide for fluid communication between formation 6 and wellbore 4. As will be described further herein, tandem sub 200 is configured to electrically connect perforating guns 100A, 100B while also providing pressure isolation between perforating guns 100A, 100B. Perforating guns 100A, 100B may be configured similarly to each other. Particularly, each perforating gun 100A, 100B includes a plurality of shaped charges that may be detonated by one or more electrical signals conveyed by the wireline 22 from the firing panel of surface assembly 11 to produce one or more explosive jets directed against casing string 12. Each perforating gun 100A, 100B may comprise a wide variety of sizes such as, for example, 2¾", 3⅛", or 3⅜", wherein the above listed size designations correspond to an outer diameter of the perforating gun 100A, 100B. PSFH 40 of tool string 20 is coupled to a lower end of the lower perforating gun 100B. PSFH 40 couples the lower perforating gun 100B of the tool string 20 to the setting tool 50 and downhole plug 60 and is generally configured to pass a signal from the wireline 22 to the setting tool 50 of tool string 20. In this embodiment, PSFH 40 also includes electrical components to fire the setting tool 50 of tool string 20.

In this embodiment, tool string 20 further includes setting tool 50 and downhole plug 60, where setting tool 50 is coupled to a lower end of PSFH 40 and is generally configured to set or install downhole plug 60 within casing string 12 to fluidically isolate desired segments of the wellbore 4. Once downhole plug 60 has been set by setting tool 50, an outer surface of downhole plug 60 seals against an inner surface of casing string 12 to restrict fluid communication through wellbore 4 across downhole plug 60. Downhole plug 60 of tool string 20 may be any suitable downhole or frac plug known in the art while still complying with the principles disclosed herein.

Figure 2:
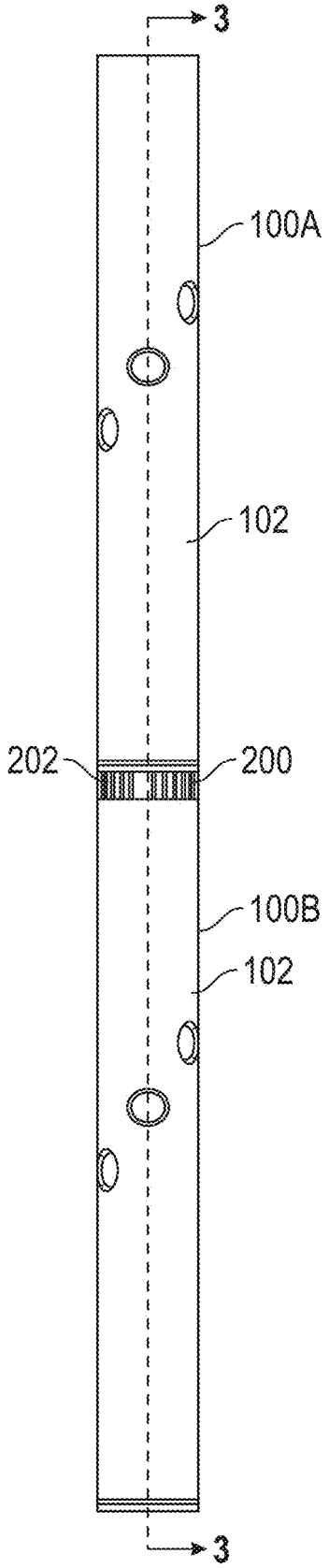
FIG. 2 is a side view of an upper perforating gun, a tandem sub, and a lower perforating gun of the tool string of FIG. 1 according to some embodiments.
Figure 3:
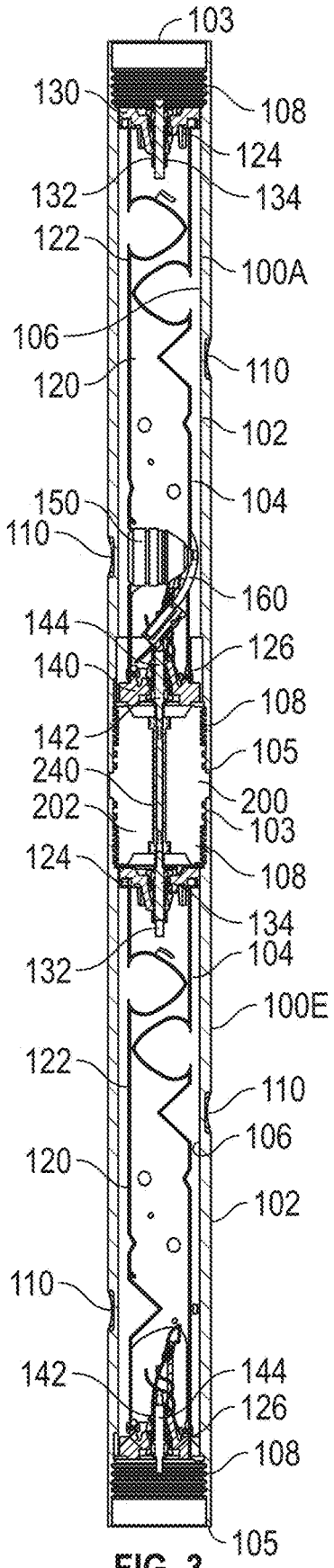
FIG. 3 is a cross-sectional view along lines 3-3 of FIG. 2.

Referring to FIGS. 2 and 3, embodiments of the perforating guns 100A, 100B, and tandem sub 200 of the tool string 20 of FIG. 1 are shown. In this exemplary embodiment, each perforating gun 100A, 100B generally includes an outer sleeve or housing 102 and a charge carrier assembly 120 positionable within the outer housing 102. The outer housing 102 of each perforating gun 100A, 100B includes a first or upper end 103, a second or lower end 105 opposite upper end 103, a central bore or passage 104 within which charge carrier assembly 120 is received. A generally cylindrical inner surface 106 defined by central passage 104 may include a releasable or threaded connector 108 at each longitudinal end 103, 105 of outer housing 102. In some embodiments, a generally cylindrical outer surface of the outer housing 102 may include a plurality of circumferentially and axially spaced recesses or scallops 110 to assist with the firing of perforating gun 100A, 100B; however, in other embodiments, outer housing 102 may not include scallops 110. For example, in other embodiments, outer housing 102 may comprise a plurality of annular openings or rings to permit shaped charges of perforating guns 100A, 100B therethrough regardless of the relative angular orientation between the shaped charge and the outer housing 102.

The charge carrier assembly 120 of each perforating gun 100A, 100B generally includes a charge carrier 122, a first or upper endplate 130, and a second or lower endplate 140. The upper endplate 130 is coupled to a first or upper end 124 of charge carrier 122 while the lower endplate is coupled to a second or lower end 126 of the charge carrier 122 opposite the upper end 124. A plurality of circumferentially and axially spaced shaped charges (not shown in FIGS. 2 and 3) are positioned in the charge carrier 122 of each charge carrier assembly 120. Particularly, each shaped charge has an outer end oriented towards one of the scallops 110 of the outer housing 102, and an inner end oriented towards the central axis of the perforating gun 100A, 100B. The charge carrier 122 is configured to couple with and house each shaped charge and orient the outer end of each shaped charge towards one of the scallops 110.

Additionally, each perforating gun 100A, 100B includes det or detonating cord 160 which extends through the charge carrier 122 of the perforating gun 100A, 100B. Each shaped charge is configured to initiate an explosion and emit an explosive charge from the outer end thereof and through one of the scallops 110 of outer housing 102 in response to receiving a ballistic signal from the det cord 160 extending through the charge carrier 122 to which the shaped charge is coupled. Particularly, the det cord 160 contacts or is otherwise ballistically coupled to the inner end of each shaped charge. In this configuration, det cord 160 of each perforating gun 100A, 100B may communicate a ballistic signal to each of the shaped charges of the perforating gun 100A, 100B.

Each perforating gun 100A, 100B may additionally include one or more electrical signal conductors or cables (not shown in FIGS. 2 and 3) which extend through the charge carrier 122 of the perforating gun 100A, 100B. Particularly, the one or more electrical cables may be electrically connected to charge carrier 122 and may facilitate the electrical grounding of one or more components of tool string 20. Additionally, the upper endplate 130 of the charge carrier assembly 120 of each perforating gun 100A, 100B comprises an upper electrical connector 132 that is electrically connected or otherwise in signal communication with one of the electrical cables of the perforating gun 100A, 100B. The upper electrical connector 132 may comprise a longitudinally translatable contact pin 134 that is biased outwardly from upper endplate 130 by a biasing member. The lower endplate 140 of the charge carrier assembly 120 of each perforating gun 100A, 100B similarly comprises a lower upper electrical connector 142 that is electrically connected or otherwise in signal communication with one of the electrical cables of the perforating gun 100A, 100B. The lower electrical connector 142 may comprise a longitudinally translatable contact pin 144 that is biased outwardly from lower endplate 140 by a biasing member.

In this configuration, an electrical signal may be passed between the upper electrical connector 132 and the lower electrical connector 142 via one of the electrical cables of the perforating gun 100A, 100B. Particularly, one of the electrical cables may comprise a ground cable while another of the electrical cables may comprise a through-wire cable. The through-wire cable of each perforating gun 100A, 100B may be in signal communication with an addressable switch (not shown in FIGS. 2 and 3) configured to selectably detonate or initiate a detonator (not shown in FIGS. 2 and 3) of the perforating gun 100A, 100B which is ballistically coupled to det cord 160. The detonator may be positioned within the charge carrier 122 of the perforating gun 100A, 100B and may be electrically connected to the switch of the perforating gun 100A, 100B via a pair of electrical leads extending therebetween.

Additionally, the detonator of each perforating gun 100A, 100B may be selectably detonated by surface assembly 11. For example, surface assembly 11 may transmit a first firing signal addressed to the switch of lower perforating gun 100B through wireline 22 to upper perforating gun 100A. The first firing signal may pass through the upper perforating gun 100A (via the through-wire cable of upper perforating gun 100A) and tandem sub 200, entering lower perforating gun 100B. The first firing signal may be communicated to the addressable switch of lower perforating gun 100B via the through-wire cable of lower perforating gun 100B. Being addressed to the lower perforating gun 100B, the switch of lower perforating gun 100B may detonate the detonator thereof in response to receiving the first firing signal. Similarly, following the actuation of lower perforating gun 100B, surface assembly 11 may transmit a second firing signal addressed to the switch of upper perforating gun 100A through wireline 22 to upper perforating gun 100A. The second firing signal may be communicated to the addressable switch of upper perforating gun 100A via the through-wire cable of perforating gun 100A. Being addressed to the upper perforating gun 100A, the switch of upper perforating gun 100A may detonate the detonator thereof in response to receiving the second firing signal.

Figure 4:
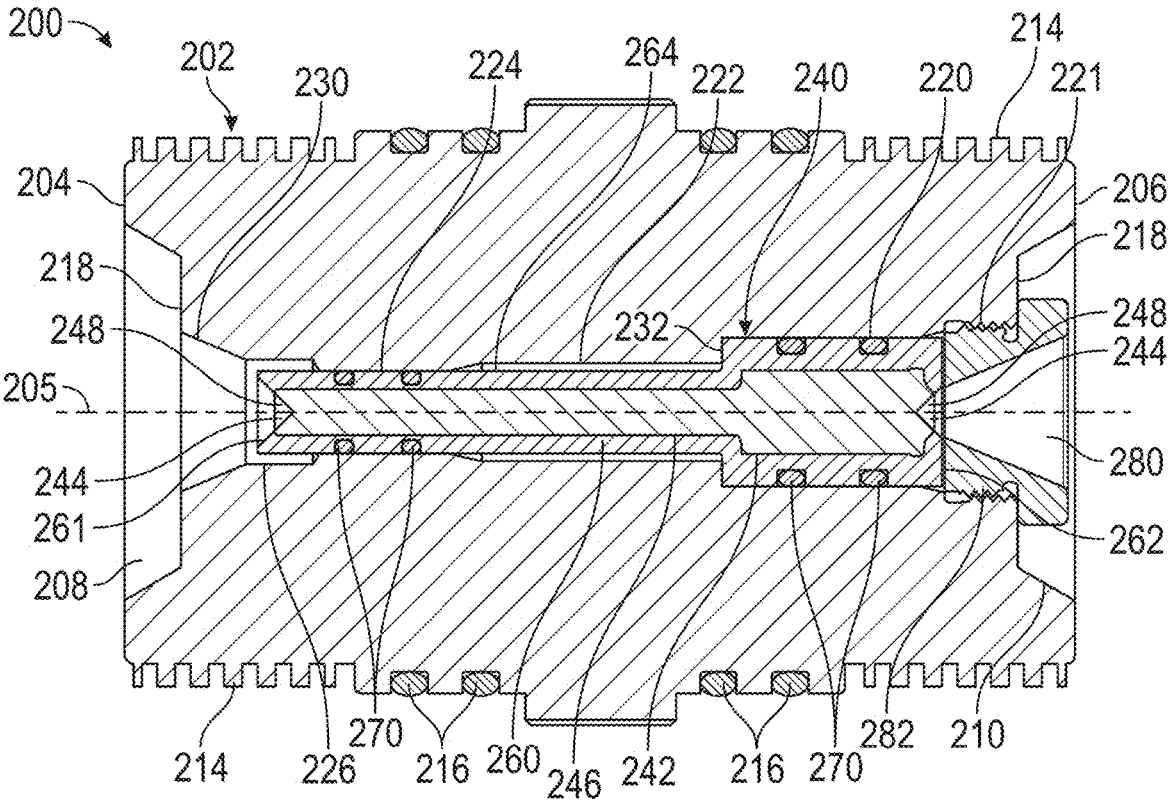
FIG. 4 is a side cross-sectional view of the tandem sub of FIG. 2.
Figure 5:
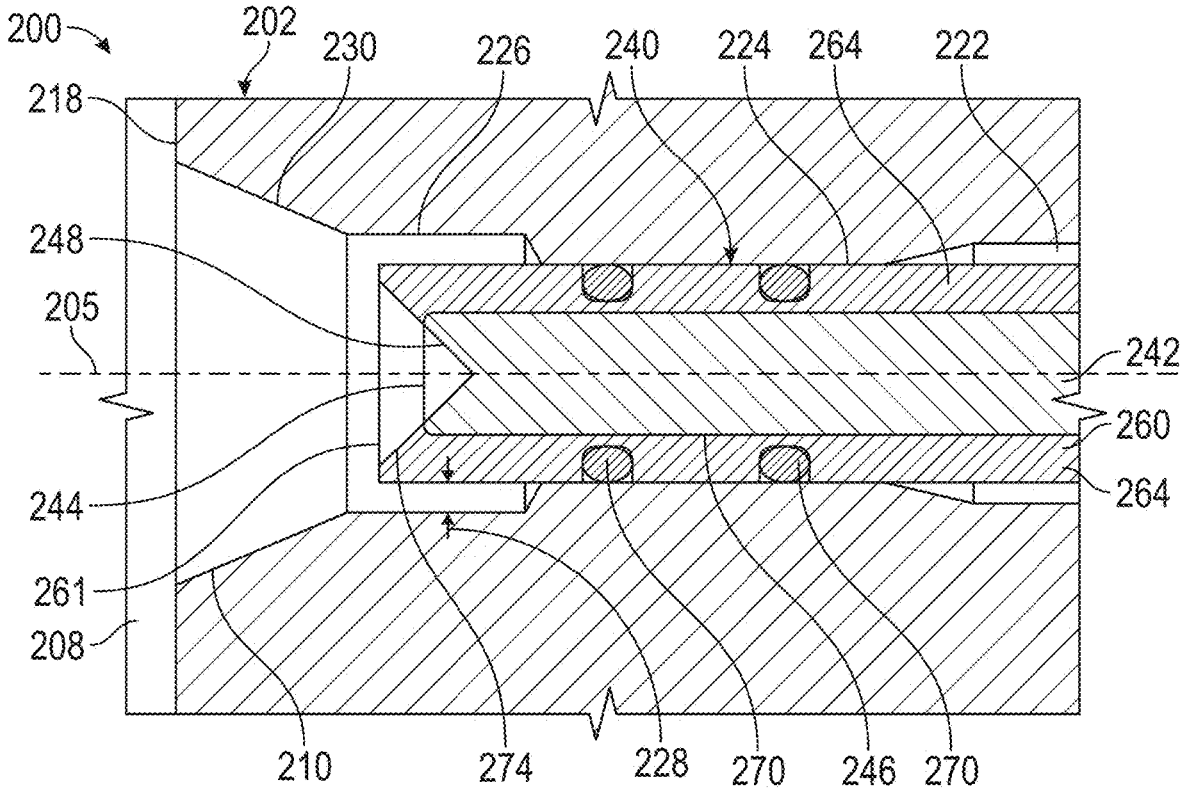
FIG. 5 is a zoomed-in side cross-sectional view of an embodiment of a pass-thru assembly of the tandem sub of FIG. 2.

Referring to FIGS. 4 and 5, tandem sub 200 of tool string 20 is generally configured to communicate electrical signals therethrough and between the pair of perforating guns 100A, 100B. Additionally, tandem sub 200 is configured to provide a pressure bulkhead whereby upper perforating gun 100A is isolated from pressure within lower perforating gun 100B and vice-a-versa. In other words, pressure within central passage 104 of the outer housing 102 of lower perforating gun 100B is not communicated and does not act upon the central passage 104 of the outer housing 102 of upper perforating gun 100A and vice-a-versa. In this manner, the pressure generated within lower perforating gun 100B following the detonation of the shaped charges 150 thereof may not be transferred to the components (e.g., addressable switch, detonator, shaped charges) of the upper perforating gun 100A.

The tandem sub 200 of tool string 20 has a central or longitudinal axis 205 (concentric with central axis 25 of tool string 20) and generally includes a cylindrical outer housing 202 and a molded pass-thru assembly 240. Outer housing 202 may be integrally or monolithically formed and may comprise a metallic material such as alloy steel, mild steel, etc. The outer housing 202 of tandem sub 200 includes a first or upper end 204, a second or lower end 206 opposite upper end 204, a central bore or passage 208 defined by a generally cylindrical inner surface 210 extending between ends 204, 206, and a generally cylindrical outer surface also extending between ends 204, 206.

In this exemplary embodiment, the outer surface of outer housing 202 includes a pair of releasable or threaded connectors 214 positioned at the ends 204, 206 thereof and a pair of annular seal assemblies 216 positioned axially between the releasable connectors 214. The releasable connector 214 positioned at the upper end 204 of outer housing 202 is configured to releasably or threadably connect to the releasable connector 108 positioned at the lower end 105 of the outer housing 102 of upper perforating gun 100A while the releasable connector 214 positioned at the lower end 206 of outer housing 202 is configured to releasably or threadably connect to the releasable connector 108 positioned at the upper end 103 of the outer housing 102 of lower perforating gun 100B. In other embodiments, outer housing 202 may couple to perforating guns 100A, 100B via mechanisms other than releasable connectors 214. Additionally, a first or upper seal assembly 216 of the pair of seal assemblies 216 is configured to sealingly engage the inner surface 106 of the outer housing 102 of upper perforating gun 100A while a second or lower seal assembly 216 of the pair of seal assemblies 216 is configured to sealingly engage the inner surface 106 of the outer housing 102 of lower perforating gun 100B upon assembly of the tandem sub 200 with the perforating guns 100A, 100B. Seal assemblies 216 may each comprise a pair of O-rings positioned in grooves formed in the outer surface 212 of outer housing 202; however, in other embodiments, the configuration of seal assemblies 216 may vary.

The inner surface 210 of outer housing 202 includes a pair of radially extending annular outer shoulders or faces 218, and a receptacle 220 extending axially from a second or downhole outer shoulder 218 of the pair of outer shoulders 218. The receptacle 220 comprises one or more surface features or threads 221 as will be discussed further herein.

The central passage 208 of outer housing 202 comprises a pass-thru passage 222 extending from a first or upper outer face 218 to an opposing second or lower outer face 218. In other embodiments, outer housing 202 may not include receptacles 220 and/or threads 221, and instead, pass-thru passage 222 may extend entirely between outer faces 218. In this exemplary embodiment, pass-thru passage 222 includes a seal bore 224 defining a minimum inner diameter of both the pass-thru passage 222 and central passage 208 of outer housing 202 generally. As will be described further herein, the portion of inner surface 210 defining seal bore 224 is configured to seal against the pass-thru assembly 240 to restrict fluid communication between the uphole and downhole ends of central passage 208. Additionally, in this exemplary embodiment, pass-thru passage 222 also includes an annular recess 226 extending from an uphole end of the seal bore 224 such that the recess 226 flanks the uphole end of the seal bore 224. It may be understood that in other embodiments the seal bore 224 and recess 226 may be positioned towards the downhole end of pass-thru passage 222 instead of towards the uphole end of pass-thru passage 222 as shown in FIGS. 4 and 5. Additionally, while recess 226 is shown as generally cylindrical in FIGS. 4 and 5, it may be understood that in other embodiments the shape of recess 226 may vary. For example, in some embodiments, recess 226 may be frustoconical in shape rather than cylindrical.

As shown particularly in FIG. 5, the inner diameter of recess 226 is greater than the inner diameter of seal bore 224. In some embodiments, the radius of recess 226 is at least 15% greater than the radius of seal bore 224. In some embodiments, the radius of recess 226 (defined by an inner diameter of recess 226) is at least 20% greater than the radius of seal bore 224 (defined by an inner diameter of seal bore 224). In certain embodiments, the radius of recess 226 is at least 30% greater than the radius of seal bore 224. In certain embodiments, the radius of recess 226 is at least 40% greater than the radius of seal bore 224. In certain embodiments, the radius of recess 226 is at least 50% greater than the radius of seal bore 224. In some embodiments, the radius of recess 226 is approximately 100% greater than the radius of seal bore 224. In some embodiments, the radius of recess 226 is approximately 50% greater than the radius of seal bore 224. In some embodiments, the radius of recess 226 is approximately 40% greater than the radius of seal bore 224.

In this configuration, a radial gap 228 (shown in FIG. 5) is formed between an outer diameter of the pass-thru assembly 240 and an inner diameter defined by the inner surface 210 of recess 226. In some embodiments, the radial gap 228 is approximately equal to or greater than 0.040 inches. In some embodiments, the radial gap 228 is approximately equal to or greater than 0.045 inches. In certain embodiments, the radial gap 228 is approximately equal to or greater than 0.050 inches. In certain embodiments, the radial gap 228 is approximately equal to or greater than 0.055 inches. In some embodiments, the radial gap 228 is approximately equal to or greater than 0.060 inches. In still other embodiments, the radial gap 228 may be equal to or substantially greater than 0.10 inches.

As will be described further herein, radial gap 228 ensures any debris or other materials (particularly soot) that has collected on surfaces of the outer housing 202 and/or pass-thru assembly 240 of tandem sub 200 do not form an inadvertent electrical connection or "short" between electrically conductive materials of the pass-thru assembly 240 and electrically conductive materials of the outer housing 202. Further, in this exemplary embodiment, pass-thru passage 222 includes a frustoconical section 230 extending from an uphole end of the recess 226 to the uphole outer face 218, where frustoconical section 230 expands in diameter moving longitudinally from a downhole end of the frustoconical section 230 to an uphole end thereof. It may be understood that in other embodiments the pass-thru passage 222 may not include frustoconical section 230.

Pass-thru assembly 240 of tandem sub 200 generally comprises an electrical conductor or pass-thru 242 and a molded insulator 260 in which the electrical conductor 242 is positioned. In this embodiment, electrical conductor 242 comprises a cylindrical signal bar and thus may also be referred to herein as signal bar 242. Signal bar 242 comprises a pair of opposing longitudinal ends 244 and a generally cylindrical outer surface 246 extending between longitudinal ends 244. Signal bar 242 may be integrally or monolithically formed and may comprise an electrically conductive material such as, for example, brass. Each longitudinal end 244 of signal bar 242 may be spaced inwardly (towards the center of tandem sub 200) from the outer faces 218 of outer housing 202 such that an axially extending gap is formed between each longitudinal end 244 and the outer faces 218. Signal bar 242 is rigid entirely across the longitudinal length thereof and each end 244 is not biased radially outwards from passage 222 by a biasing member. In other words, in at least this exemplary embodiment, pass-thru assembly 240 does not include a biasing member for biasing any component or feature of pass-thru assembly 240, including signal bar 242.

A conical recess or receptacle 248 may be formed in each longitudinal end 244 of signal bar 242 such that each conical receptacle 248 extends concentrically with central axis 205. The outer surface 246 of signal bar 242 may comprise one or more surface features or protrusions configured to increase an area of outer surface 246 along the portions of outer surface 246 which the protrusions extend where the protrusions enhance the bond formed between the signal bar 242 and the molded insulator 260.

Additionally, the molded insulator 260 of pass-thru assembly 240 comprises a first or uphole end 261, a longitudinally opposed second or downhole end 262, and an outer surface 264 extending longitudinally between ends 261 and 262. Molded insulator 260 is annular and receives the signal bar 242 in a central passage thereof. An inner surface of molded insulator 260 may comprise one or more surface features or inner protrusions configured to increase an area of the inner surface along the portions of the inner surface which the protrusions extend where these protrusions may interlock with protrusions formed on the outer surface 246 of signal bar 242 to assist in securing the molded insulator 260 to the signal bar 242. The molded insulator 260 may be integrally or monolithically formed and may comprise an electrically insulating material. In some embodiments, molded insulator 260 may comprise a polymeric material such as Polyether ether ketone (PEEK), Polyetherimide (PEI), etc.; however, molded insulator 260 may comprise various electrically insulating materials. In this manner, molded insulator 260 may electrically insulate signal bar 242 from outer housing 202 which may comprise an electrically conductive material in some embodiments.

In some embodiments, a ratio of the radial gap 228 to the outer diameter of the pass-thru assembly 240 (e.g., defined by the outer surface 264 of molded insulator 260) is between 5% and 25%. In some embodiments, the ratio of the radial gap 228 to the outer diameter of the pass-thru assembly 240 is between 6% and 18%. In certain embodiments, the ratio of the radial gap 228 to the outer diameter of the pass-thru assembly 240 is between 7.5% and 12%.

In this exemplary embodiment, molded insulator 260 has a maximum length extending between the longitudinal ends 261 and 262 thereof which is greater than the maximum length of signal bar 242; however, it may be understood that in other embodiments the maximum length of signal bar 242 may be equal to or greater than the maximum length of insulator 260 in other embodiments. Additionally, in this exemplary embodiment, pass-thru assembly 240 includes a pair of annular seal assemblies 270 positioned along the outer surface 264 of molded insulator 260. Particularly, a first or uphole of the seal assemblies 270 is positioned proximal the uphole end 261 of molded insulator 260 while a second or downhole of the seal assemblies 270 is positioned proximal the downhole end 262 of molded insulator 260. In this exemplary embodiment, each seal assembly 270 comprises a pair of annular seals (e.g., O-ring seals) in sealing contact with the outer surface 264 of molded insulator 260. However, it may be understood that the configuration of seal assemblies 270 may vary in other embodiments.

The pass-thru assembly 240 is slidably received in the pass-thru passage 222 of outer housing 202. Once installed in the outer housing 202, relative axial or longitudinal movement between the outer housing 202 and pass-thru assembly 240 is resisted by an annular shoulder 32 formed by the inner surface 210 of outer housing 202 and positioned at the uphole end of receptacle 220, and by an annular lock nut or retainer 280 (shown in FIG. 4) having external threads 282 formed thereon for threadably coupling to the threads 221 formed on the downhole end of the receptacle 220.

A frustoconical recess or receptacle 274 (shown particularly in FIG. 5) may be formed in each longitudinal end 261 and 262 of molded insulator 260 such that each frustoconical receptacle 274 extends concentrically with central axis 205. The longitudinal ends 244 of signal bar 242 may be positioned at inner ends of frustoconical receptacles 274. In other words, each longitudinal end 244 of signal bar 242 is positioned in a corresponding frustoconical receptacle 274 of molded insulator 260. In some embodiments, the conical receptacles 248 of signal bar 242 are flush with the frustoconical receptacles 274 of molded insulator 260. An axial gap is formed between the longitudinal ends 244 of signal bar 242 and the longitudinal ends 261 and 262 of molded insulator 260 with the longitudinal ends 244 of signal bar 242 being recessed within the frustoconical receptacles 274 of molded insulator 260. In this configuration, there is no outward projection or pin of signal bar 242 extending from one of the frustoconical receptacles 274 that may be inadvertently damaged or broken off during operation of tandem sub 200.

Following the assembly of tandem sub 200 with perforating guns 100A, 100B, the contact pin 144 of the lower electrical connector 142 of upper perforating gun 100A may be received in the conical receptacle 248 positioned at an upper longitudinal end 244 of signal bar 242, thereby establishing electrical contact and signal communication between upper perforating gun 100A and tandem sub 200. Similarly, contact pin 134 of the upper electrical connector 132 of lower perforating gun 100B may be received in the conical receptacle 248 positioned at a lower longitudinal end 244 of signal bar 242, thereby establishing electrical contact and signal communication between lower perforating gun 100B and tandem sub 200. The conical shape of frustoconical receptacles 274 of molded insulator 260 and conical receptacles 248 of signal bar 242 may guide contact pins 134, 144 into aligned engagement with conical receptacles 248.

Referring to FIGS. 6-9, an exemplary process for assembling tandem sub 200 is shown. The process for assembling tandem sub 200 described herein may pertain either to an original assembly of the tandem sub 200 or to a subsequent assembly of the tandem sub 200 following use downhole in a wellbore. For example, in some instances, following the performance of a perforating operation using the tandem sub 200 the tandem sub 200 may be disassembled (removing the pass-thru assembly 240 from the outer housing 202 thereof) to permit the refurbishment of the disassembled outer housing 202 and/or pass-thru assembly 240. Following refurbishment, the refurbished outer housing 202 may be reassembled either with a refurbished pass-thru assembly 240 or with a new pass-thru assembly 240 that has not yet been used downhole as part of a perforating operation.

Figure 6:
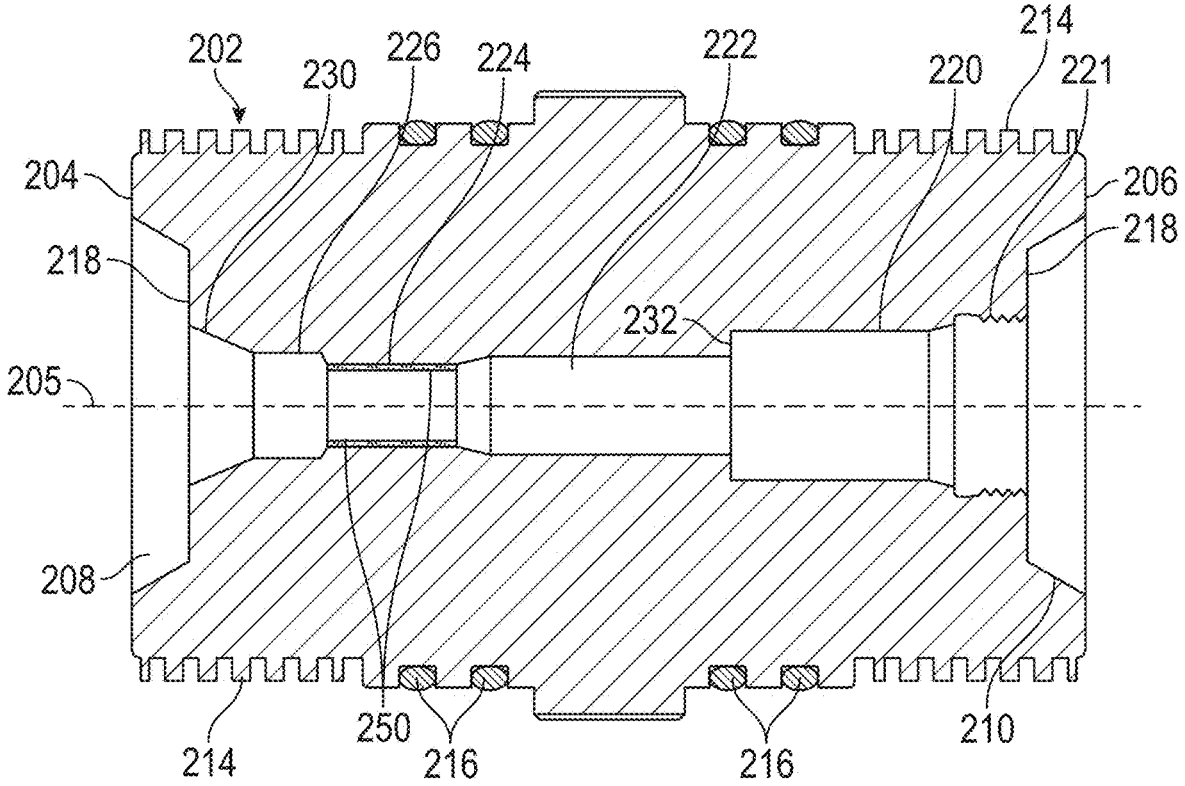
FIGS. 6-9 are side cross-sectional views of an exemplary process for forming the tandem sub of FIG. 2.

In the instance of assembling a refurbished outer housing 202 with either a refurbished or a new pass-thru assembly 240, it may be understood that foreign materials may collect on the inner surface 210 of outer housing 202 during and/or following the performance of a perforating operation using a tandem sub 200 comprising the outer housing 202. Particularly, foreign materials 250 may collect, among other locations, along the seal bore 224 of the outer housing 202 as indicated in FIG. 6. In at least some instances the refurbishment of the outer housing 202 may inadvertently fail to adequately clean the outer housing 202, including the seal bore 224 such that foreign materials 250 may remain in the seal bore 224 following completion of the refurbishment of the outer housing 202. Particularly, electrically conductive materials such as soot produced during downhole operation of the tandem sub 200 may collect on surfaces of the outer housing 202 including within the seal bore 224 of the outer housing 202.

Figure 7:
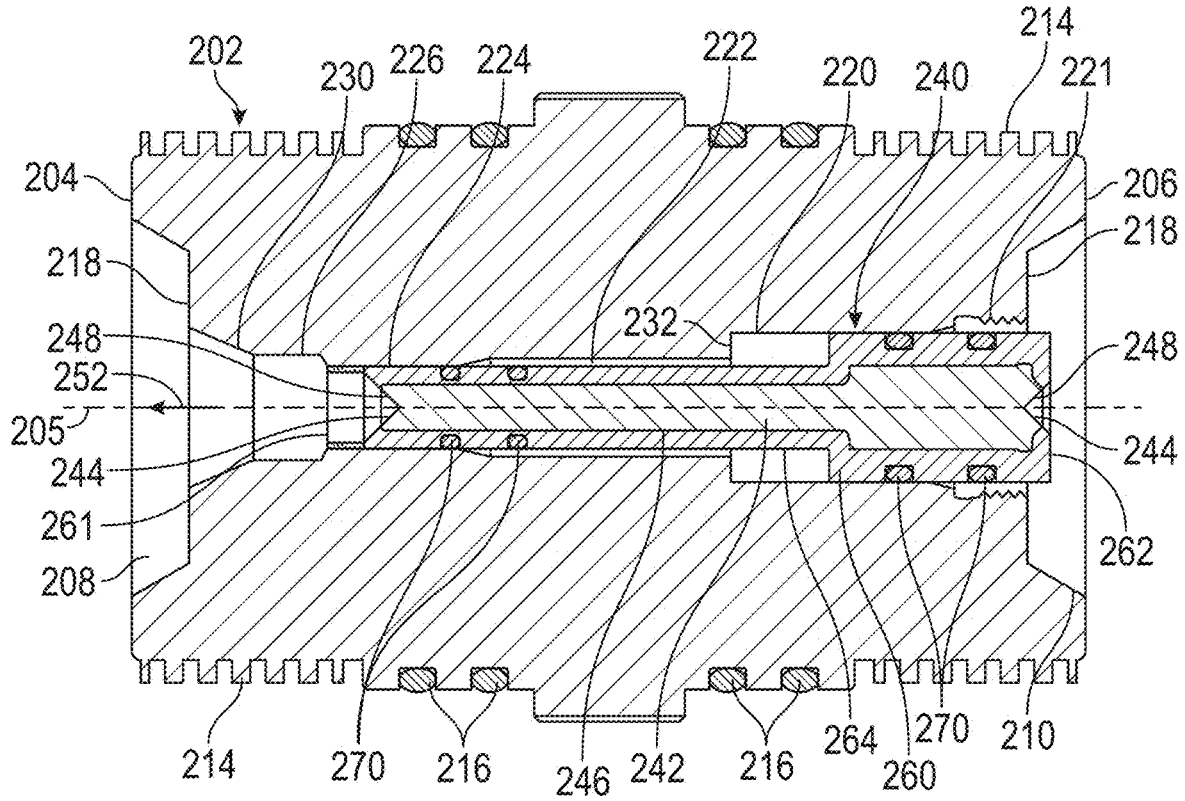
Figure 8:
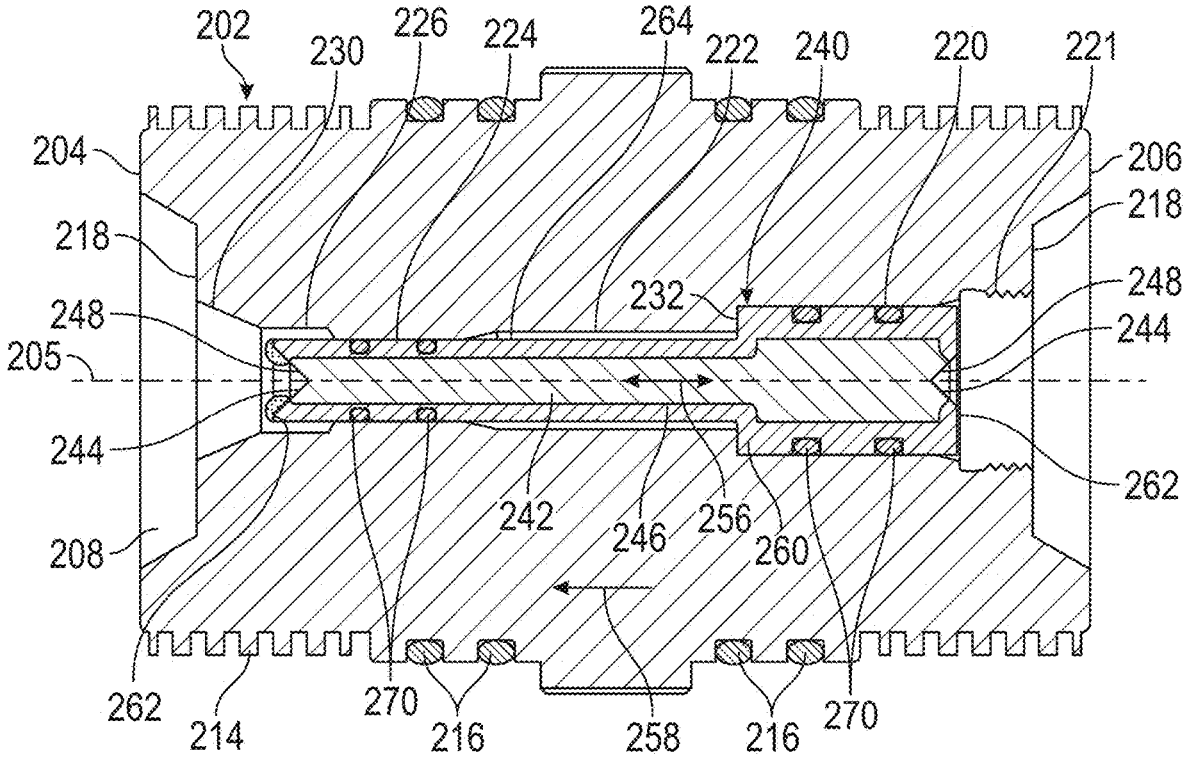
Figure 9:
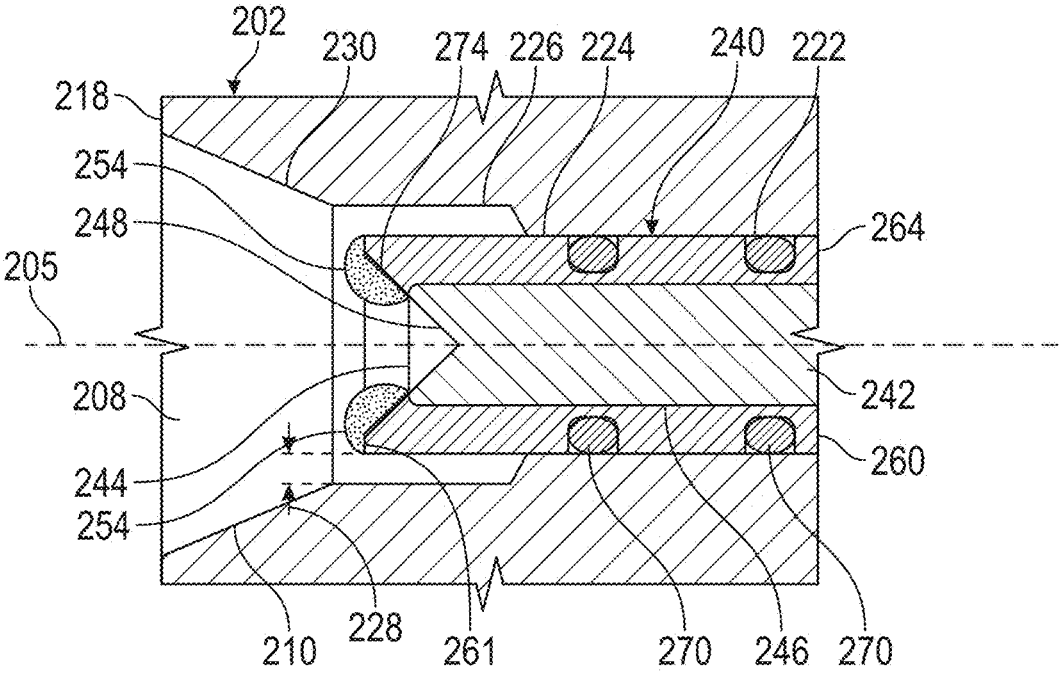

Beginning at FIGS. 6 and 7, following the fabrication of outer housing 202 and pass-thru assembly 240, the pass-thru assembly 240 is slidably inserted (e.g., manually by an assembler of the tandem sub 200) through the central passage 208 of outer housing 202 as indicated by arrow 252 in FIG. 7. Turning to FIGS. 8 and 9, as the pass-thru assembly 240 is slid through the central passage 208 of outer housing 202, at least some of any foreign materials 250 (e.g., soot) remaining in seal bore 224 of outer housing 202 may collect on the uphole end 261 (indicated by numerals 254 in FIG. 9) of molded insulator 260 in response to sliding contact between the portion of inner surface 210 defining seal bore 224 and the outer surface 264 of molded insulator 260.

In some instances, the collected materials 254 may contact an adjacently located longitudinal end 244 of signal bar 242 thereby potentially establishing an electrical connection or pathway extending from the longitudinal end 244 of signal bar 242 to the collected materials 254. It may be understood that the establishment of an additional electrical connection or pathway extending between the collected materials 254 and the inner surface 210 of outer housing 202 would result in the shorting out of the electrical circuit comprising the signal bar 242. As an example, during operation of the tandem sub 200 downhole during a perforating operation, an electrical signal path (indicated by arrow 256 in FIG. 8) extends through the signal bar 242 to electrical components of a tool string comprising the tandem sub 200 located uphole and downhole from the signal bar 242. Additionally, during operation of the tandem sub 200, an electrical ground path (indicated by arrow 258 in FIG. 8)

extends uphole through the outer housing 202 of tandem sub 200 towards the surface of the given wellbore in which the tandem sub 200 is positioned. The signal path 256 and ground path 258 collectively form at least a portion of the downhole electrical circuit extending through tandem sub 200 during the performance of a perforating operation.

A potential shorting of this downhole electrical circuit via the formation of a direct electrical connection between signal path 256 and ground path 258. For instance, the electrical connection potentially formed between collected materials 254 and the longitudinal end 244 of sub bar 242 could result in the inadvertent formation of an electrical connection between collected materials 254 and the inner surface 210 of outer housing 202, such as via the formation of an electrical arc extending therebetween, should the inner surface 210 be located in proximity to the collected materials 254. However, the presence of radial gap 228 (shown in FIG. 9) ensures, or at a minimum mitigates the risk of, the inadvertent formation of an electrical connection between collected materials 254 (which may be electrically conductive soot or other materials) and the inner surface 210 of outer housing 202 by radially spacing (via radial gap 228) the outer surface 264 of molded insulator 260 from the portion of the inner surface 210 defining the recess 226 of outer housing 202. Thus, the size of the radial gap 228 may be designed or configured so as to minimize the probability of the formation of an electrical connection (e.g., via electrical arcing) between any collected materials 254 located on the uphole end 261 of molded insulator 260 and the inner surface 210 of outer housing 202. It may be understood that the size of radial gap 228 may vary depending on the circumstances of the given application, such as the magnitude of the electrical voltage along the signal path 256 described above. To state in other words, the size of radial gap 228 may be selected based on the characteristics of the electrical circuit formed partially by the signal bar 242 of pass-thru assembly 240, such as the electrical voltage of the electrical circuit. For instance, with everything else being equal, an increase in the electrical voltage of the electrical circuit may require a relatively greater radial gap 228 in order to avoid the potential of electrical arcing between the collected materials 254 and the inner surface 210 of outer housing 202.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. As an example, while contact pins 134, 144 of the electrical connectors 132, 142 described above are shown as conical and receivable within a corresponding conical receptacle; in other embodiment, contact pins 134, 144 (as well as other contact pins described above) may comprise planar or flat endfaces which contact corresponding planar or flat endfaces to establish an electrical connection therebetween.

The relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A tandem sub for a perforating gun system, comprising:

a tubular housing comprising a longitudinal first end, a longitudinal second end opposite the first end, a central passage defined by an inner surface that forms a seal bore, an annular receptacle, and an annular shoulder that divides the seal bore from the annular receptacle, the seal bore defining a minimum inner diameter of the central passage such that a minimum inner diameter of the seal bore is less than a minimum inner diameter of the annular receptacle, wherein the housing is connectable to an outer housing of a perforating gun; and an electrical pass-thru assembly configured to electrically connect to the perforating gun and comprising a longitudinal first end, a longitudinal second end opposite the first end, an electrically conductive signal bar, and an electrical insulator surrounding a periphery of the signal bar;

wherein the signal bar has a longitudinal first end defining a first electrical contact of the tandem sub and configured to establish an electrical connection with a first electrical component separate from and external the tandem sub, and a longitudinal second end opposite the first end and defining a second electrical contact of the tandem sub that is longitudinally opposite and electrically connected to the first electrical contact and configured to establish an electrical connection with a second electrical component separate from and external the tandem sub, wherein the signal bar is rigid along the entire longitudinal length thereof extending from the first end to the second end;

wherein the insulator has an outer surface sealingly contacting the seal bore of the housing when the pass-thru assembly is installed in the housing;

wherein one of the first end and the second end of the pass-thru assembly longitudinally overlaps the annular receptacle of the housing when the pass-thru assembly is installed in the housing whereby a radial gap is formed between the outer surface of the insulator at a longitudinal end of the electrical pass-thru assembly and a portion of the inner surface of the housing defining the annular receptacle.

2. The tandem sub of claim 1, wherein the radial gap is equal to or greater than 0.040 inches.

3. The tandem sub of claim 1, wherein the radial gap is equal to or greater than 0.050 inches.

4. The tandem sub of claim 1, wherein the radial gap is equal to or greater than 0.060 inches.

5. The tandem sub of claim 1, wherein a ratio of the radial gap to an outer diameter of the pass-thru assembly is between 5% and 25%.

6. The tandem sub of claim 1, wherein a ratio of the radial gap to an outer diameter of the pass-thru assembly is between 6% and 18%.

7. The tandem sub of claim 1, wherein a ratio of the radial gap to an outer diameter of the pass-thru assembly is between 7.5% and 12%.

8. The tandem sub of claim 1, wherein the annular receptacle of the housing is located directly adjacent to the seal bore.

9. The tandem sub of claim 1, wherein a minimum radius of the annular receptacle is at least 20% greater than a radius of the seal bore.

10. The tandem sub of claim 1, wherein a minimum radius of the annular receptacle is at least 40% greater than a radius of the seal bore.

11. The tandem sub of claim 1, wherein a minimum radius of the annular receptacle is at least 50% greater than a radius of the seal bore.

12. The tandem sub of claim 1, wherein a minimum radius of the annular receptacle is at least 100% greater than a radius of the seal bore.

13. The tandem sub of claim 1, wherein the first end of the pass-thru assembly corresponds to an uphole end of the pass-thru assembly when the pass-thru assembly is installed in the housing.

14. The tandem sub of claim 1, wherein the pass-thru assembly comprises one or more annular seal assemblies positioned along the outer surface of the insulator for sealing against the seal bore of the housing when the pass-thru assembly is installed in the outer housing.

15. The tandem sub of claim 1, wherein the signal bar is positioned in the central passage of the housing.

16. The tandem sub of claim 15, wherein the central passage of the housing comprises a longitudinal first end, a longitudinal second end opposite the first end, and wherein the pass-thru assembly creates a pressure seal between the first end and the second end of the central passage.

17. The tandem sub of claim 1, wherein the insulator of the pass-thru assembly comprises a molded insulator sealably adhered to an outer surface of the signal bar.

18. The tandem sub of claim 1, wherein the insulator extends continuously across the entire longitudinal length of the signal bar.

19. A method for forming a tandem sub for a perforating gun system, comprising:

(a) forming a tubular housing comprising a longitudinal first end, a longitudinal second end opposite the first end, a central passage defined by an inner surface that forms a seal bore, an annular receptacle, and an annular shoulder that divides the seal bore from the annular receptacle, the seal bore defining a minimum inner diameter of the central passage such that a minimum inner diameter of the seal bore is less than a minimum inner diameter of the annular receptacle, wherein the housing is connectable to an outer housing of a perforating gun; and (b) installing a pass-thru assembly comprising an electrically conductive signal bar and a surrounding electrical insulator in the central passage of the housing whereby a radial gap is formed between an outer surface of the insulator of the pass-thru assembly at a longitudinal end of the pass-thru assembly and a portion of the inner surface of the housing defining the annular receptacle, wherein an outer surface of the insulator of the pass-thru assembly sealingly contacts the seal bore of the housing when the pass-thru assembly is installed in the central passage of the housing.

20. The method of claim 19, wherein a magnitude of the radial gap is selected based on one or more parameters of an electrical circuit formable using the signal bar of the pass-thru assembly.

21. The method of claim 19, further comprising:

(c) positioning one or more annular seal assemblies along the outer surface of the insulator of the pass-thru assembly whereby the one or more seal assemblies seal against a portion of the inner surface of the housing defining the seal bore when the pass-thru assembly is installed in the central passage of the housing.

22. The method of claim 19, wherein (b) comprises longitudinally sliding the pass-thru assembly into and through the central passage of the housing whereby the end of the pass-thru assembly longitudinally overlaps the annular receptacle of the housing.

23. The method of claim 19, wherein the radial gap is equal to or greater than 0.040 inches.

24. The method of claim 19, wherein the radial gap is equal to or greater than 0.050 inches.

25. The method of claim 19, wherein the radial gap is equal to or greater than 0.060 inches.

26. The method of claim 19, wherein a ratio of the radial gap to an outer diameter of the pass-thru assembly is between 5% and 25%.

27. The method of claim 19, wherein a ratio of the radial gap to an outer diameter of the pass-thru assembly is between 6% and 18%.

28. The method of claim 19, wherein a ratio of the radial gap to an outer diameter of the pass-thru assembly is between 7.5% and 12%.

29. The method of claim 19, wherein a minimum radius of the annular receptacle is at least 20% greater than a radius of the seal bore.

30. The method of claim 19, wherein a minimum radius of the annular receptacle is at least 40% greater than a radius of the seal bore.

31. The method of claim 19, wherein a minimum radius of the annular receptacle is at least 50% greater than a radius of the seal bore.

32. The method of claim 19, wherein a minimum radius of the annular receptacle is at least 100% greater than a radius of the seal bore.

33. A method for operating a perforating gun system, comprising:

(a) connecting a tandem sub of the perforating gun system to a perforating gun of the perforating gun system, the tandem sub comprising a tubular housing having a central passage and a pass-thru assembly comprising an electrically conductive signal bar and a surrounding electrical insulator, the pass-thru assembly installed in the central passage of the housing whereby a radial gap is formed between an outer surface of the insulator of the pass-thru assembly at a longitudinal end of the pass-thru assembly and a portion of an inner surface of the housing forming an annular receptacle, wherein the inner surface forms a seal bore, the annular receptacle, and an annular shoulder that divides the seal bore from the annular receptacle such that a minimum inner diameter of the seal bore is less than a minimum inner diameter of the annular receptacle, and wherein an outer surface of the insulator sealingly contacts the seal bore;

(b) conveying a tool string comprising the tandem sub and the perforating gun connected therewith into a wellbore;

(c) establishing an electrical signal path extending through the signal bar of the pass-thru assembly of the tandem sub; and (d) establishing an electrical ground path extending through the housing of the tandem sub and spaced from the signal path by the radial gap.

34. The method of claim 33, wherein the radial gap is equal to or greater than 0.040 inches.

35. The method of claim 33, wherein the radial gap is equal to or greater than 0.050 inches.

36. The method of claim 33, wherein the radial gap is equal to or greater than 0.060 inches.

37. The method of claim 33, wherein a ratio of the radial gap to an outer diameter of the pass-thru assembly is between 5% and 25%.

38. The method of claim 33, wherein a ratio of the radial gap to an outer diameter of the pass-thru assembly is between 6% and 18%.

39. The method of claim 33, wherein a ratio of the radial gap to an outer diameter of the pass-thru assembly is between 7.5% and 12%.

40. The method of claim 33, wherein a minimum radius of the annular receptacle is at least 20% greater than a radius of the seal bore.

41. The method of claim 33, wherein a minimum radius of the annular receptacle is at least 40% greater than a radius of the seal bore.

42. The method of claim 33, wherein a minimum radius of the annular receptacle is at least 50% greater than a radius of the seal bore.

43. The method of claim 33, wherein a minimum radius of the annular receptacle is at least 100% greater than a radius of the seal bore.

* * * * *